United States Patent [19]

van Gorkum

[11] Patent Number: 4,806,821

[45] Date of Patent: Feb. 21, 1989

[54] CATHODE RAY TUBE HAVING AN ELECTRON GUN WITH BIPOTENTIAL FOCUSING LENS

[75] Inventor: Aart A. van Gorkum, Tokyo, Japan

[73] Assignee: U.S. Philips Corporation, New York, N.Y.

[21] Appl. No.: 40,009

[22] Filed: Apr. 17, 1987

[30] Foreign Application Priority Data

May 30, 1986 [GB] United Kingdom ..... 8613170

[51] Int. Cl.[4] ..... H01J 29/62; H01J 29/94

[52] U.S. Cl. ..... 313/449; 313/481

[58] Field of Search ..... 313/449, 481, 447, 448

[56] References Cited

U.S. PATENT DOCUMENTS

| | | | |
|---|---|---|---|
| 3,183,391 | 5/1965 | Benway | 313/481 |
| 4,481,445 | 11/1984 | Gorski | 313/449 X |
| 4,498,028 | 2/1985 | Gorski | 313/449 X |
| 4,607,187 | 8/1986 | Villanyi | 313/447 X |
| 4,665,340 | 5/1987 | Odenthal et al. | 313/449 |

FOREIGN PATENT DOCUMENTS

| | | | |
|---|---|---|---|
| 150961 | 11/1979 | Japan | 313/449 |
| 825898 | 12/1959 | United Kingdom . | |

*Primary Examiner*—Palmer C. DeMeo

*Attorney, Agent, or Firm*—Robert J. Kraus

[57] ABSTRACT

A cathode ray tube having an electron gun with a triode section and bi-potential focusing lens electrodes. Generally such focusing lens electrodes comprise two juxtaposed cylindrical electrodes of which the one nearer the screen (accelerating electrode) is at the screen voltage of approximately 30 kV. If it is desired to increase the diameter of the focusing lens the voltage difference between the focusing electrode and the other cylindrical electrode (accelerating electrode) must be increased. The effect of this is to make the focusing electrode voltage unacceptably low with respect to the triode section. This problem is overcome by providing the accelerating electrode 29 with a diaphragm 30 having an aperture whose area is less than half the cross-sectional area of the focusing electrode (24). The presence of the diaphragm enables the focusing electrode voltage to be increased to an acceptable level and be equal to that applied to a prefocusing lens electrode (22), enabling these electrodes (22, 24) to be interconnected electrically and/or mechanically.

10 Claims, 2 Drawing Sheets

CATHODE RAY TUBE HAVING AN ELECTRON GUN WITH BIPOTENTIAL FOCUSING LENS

BACKGROUND OF THE INVENTION

The present invention relates to a cathode ray tube having an electron gun with a bi-potential lens.

Various types of electron lenses are used when focusing electron beams in electron guns. A type frequently used is the bipotential electron lens consisting of two axially spaced apart, concentric cylinders. In operation a voltage difference is applied across the cylinders with the cylinder nearer the screen of the cathode ray tube being typically at the screen voltage. An example of such an electron lens is used in the electron gun system of the 30AX color display tube manufactured by N.V. Philips' Gloeilampenfabrieken.

When using an accelerating bipotential lens, one is bound to a given voltage difference between focusing voltage, that is the voltage applied to the first of the two cylinders in the electron beam path from the cathode to the screen, and the accelerating voltage, normally the screen voltage, applied to the second of the two cylinders. This voltage difference is determined by taking into account the distance from the lens to the object, the distance from the lens to the screen and the diameter of the lens. In the case of large diameter electron lenses, such as may be used in projection television tubes, the value of this voltage difference is such that a low focusing voltage, which is often unacceptably low, is the result. A theoretical study of electron lenses has led to the introduction of a quality factor (C), which includes the spherical aberration which is regarded as the dominant lens defect. The factor C raised to the power $\frac{1}{4}$, that is $C^{\frac{1}{4}}$, is directly proportional to the spot size produced at the screen. It was found that the bipotential lens yielded more favorable results at equal values of the lens-to-screen distance (Q), object-to-lens distance (P) and lens diameter (D) than the so-called uni-potential lens. The results could be summarized in the simple quality factor formula:

$$C^{\frac{1}{4}} = K \cdot \frac{Q}{P^{\frac{1}{4}} D^{\frac{1}{4}}}$$

in which K has a value on the order 1.5 for a bipotential lens. The formula indicates that the quality increases as the diameter of the lens increases. However such large diameters cause problems because with a fixed screen voltage on the second cylinder, the focusing voltage on the first cylinder decreases with an increasing lens diameter in order to obtain the desired given voltage ratio. Such a low focusing voltage consequently occurs at the end of the triode part of the electron gun making it difficult to achieve the desired angle of aperture generated by the triode part. The presence of a high voltage in the triode part of the gun is required to achieve the desired angle of aperture. Moreover, the use of a high voltage in the triode region enables the introduction of a strong prefocusing lens. Proper positioning and strength of this prefocusing lens reduces the spot size. The solution of using a prefocusing electrode which is held at a voltage greater than that applied to the focusing electrode can be simplified if it is possible to electrically connect this electrode to the focus voltage or to mechanically incorporate this prefocusing electrode in the focus cylinder.

SUMMARY OF THE INVENTION

An object of the present invention is to provide a cathode ray tube having a bipotential electron lens with a large-diameter focusing electrode at a high voltage without increasing in spot size due to spherical aberration.

According to the present invention there is provided a cathode ray tube comprising an envelope in which there is provided a cathodoluminescent screen on a faceplate and an electron gun. The electron gun has a triode part and a bipotential focusing lens. The focusing lens is formed by a first cylindrical electrode and a second electrode comprising a diaphragm adjacent to, but spaced from, the first electrode. The diaphragm includes an aperture having a cross sectional area less than half of the cross-sectional area of the first electrode and wherein the distance of the lens from the screen is less than would be the case if the lens was formed by two successively arranged coaxial cylindrical electrodes of cross-sectional area similar to that of the first electrode.

The cathode ray tube made in accordance with the present invention enables the focusing electrode to have a large diameter and simultaneously to be operated at a higher voltage while having an acceptable spherical aberration quality factor. This leads to a flexibility of use of bipotential lens that hitherto has not been achievable.

If desired the diaphragm may have a cylindrical portion on its outer periphery extending toward the first electrode, the axial length of the cylindrical portion being less than the radius of the first electrode. The provision of the cylindrical portion facilitates the alignment of the electrodes of the focusing lens.

The aperture in the diaphragm may have a shape to influence the spot shape at the screen. Such apertures shapes may include circular, elliptical, rectilinear for example square and rectangular, or polygonal.

British Patent Specification No. 825,898 discloses a cathode ray tube having an electron gun comprising, in order, a cathode, a modulating grid, a cylindrical first anode, a first apertured flat plate electrode, a cylindrical focusing electrode (or second apertured flat plate electrode. In operation the first and second anodes and the diaphragm are at 2 kV, the first apertured flat plate electrode is at a voltage comparable to the cathode voltage and the third anode is at 10 kV. The electric fields between the first anode, the first apertured electrode and the diaphragm constitute an electron lens system which produces a narrow, parallel-sided beam directed toward the aperture in the third anode. The electron beam is focused on the screen by the electric field between the elongate second anode and the apertured third plate electrode. The patentees state that the lens field formed by providing the first apertured plate electrode between the first and second anodes enables the spot on the screen to be of constant shape for a range of beam currents. This specification does not address itself to the problem of how to obtain a bipotential lens of a large diameter which can have an acceptable quality factor. Furthermore in the cathode ray tube made in accordance with the present invention no extra lensing electrodes are required. Also in the event of using a prefocusing lens formed by an apertured flat plate, this can be at substantially the same voltage as the cylindrical electrode, thereby avoiding the necessity for a separate external connection. Thus the prefocusing electrode and the first cylindrical electrode may be electrically connected internally of the tube envelope and, if desired, they may also be mechanically connected. Compared to the known type of bipotential focusing lens constituted by successive, coaxially arranged cylindrical electrodes and a prefocusing electrode at a different voltage, the electron gun used in the cathode ray tube made in accordance with the present invention is structurally simpler while still enabling a spot of an acceptable quality to be obtained.

The electron gun may include a prefocusing electrode between the triode section and the cylindrical electrode. These electrodes may be electrically and/or mechanically interconnected.

If desired the diaphragm may have a cylindrical extension surrounding the aperture on the screen side thereof in order to prevent getter material, particularly barium produced by a neck getter, from being deposited in the lens electrodes during the getting operation.

BRIEF DESCRIPTION OF THE DRAWINGS

The present invention will now be explained and described, by way of example, with reference to the accompanying drawing figures, wherein.

In the drawings corresponding reference numerals have been used to indicate the same features.

DESCRIPTION OF THE PREFERRED EMBODIMENTS

Figure 1:
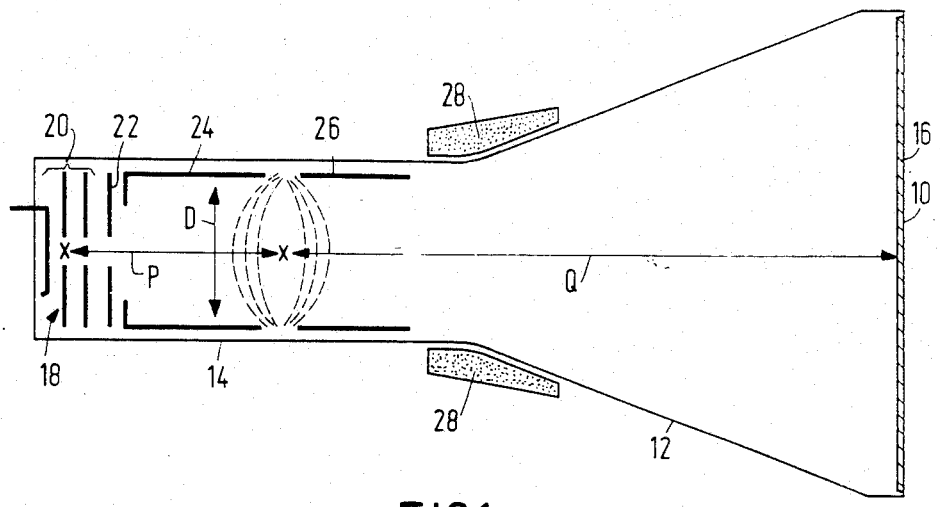
FIG.1 PRIOR ART
FIG. 1 is a diagrammatic longitudinal sectional view through a prior art type of cathode ray tube.

The cathode ray tube shown in FIG. 1 comprises an envelope formed by a faceplate 10, a cone 12 and a neck 14. On the inside of the faceplate 10 there is a cathodoluminescent screen 16. A single beam electron gun 18 is provided in the neck 14 and comprises a triode section 20, a prefocusing lens electrode 22 and bipotential focusing lens electrodes including a cylindrical focusing electrode 24 and a cylindrical accelerating electrode 26 axially spaced therefrom. Magnetic deflection means 28 is provided at the neck-cone transition for scanning the single beam over the screen 16.

In a typical mode of operation of the illustrated cathode ray tube, for example a projection television tube, it is desirable to make the electron lens as large as possible. This means that the voltage difference across the lens gap between the cylindrical electrodes 24, 26 will become larger to maintain the focusing condition on the screen. Thus as the electrode 26 is normally at the screen potential ($V_s$) of say 30 kV then the potential ($V_f$) on the electrode 24 is on the order 5 kV. However the prefocusing lens electrode 22 is typically required to be at 8 kV which means that separate external connections are required for the electrodes 22, 24.

As already mentioned in the preamble a quality factor ($C^{\frac{1}{4}}$) indicating the extent of spherical aberration can be defined in terms of the lens diameter (D), object-to-lens distance (P) and lens-to-screen distance (Q) by means of the following formula $$C^{\frac{1}{4}} = K \cdot \frac{Q}{P^{\frac{1}{4}} \cdot D^{\frac{1}{2}}}$$

where for a bipotential lens K has a value on the order of 1.5. In FIG. 1 the object-to-lens distance, P, is 55 mm and the lens-to-screen distance, Q, is 155 mm. If the lens diameter D is made as large as possible, say 18 mm, then the potential difference $V_s < V_f$ becomes large and the focusing voltage $V_f$ low. Such a low value of $V_{hf}$ is unacceptable because it is difficult to achieve the desired angle of aperture generated by the triode part 20 at such a low focusing voltage.

Figure 2:
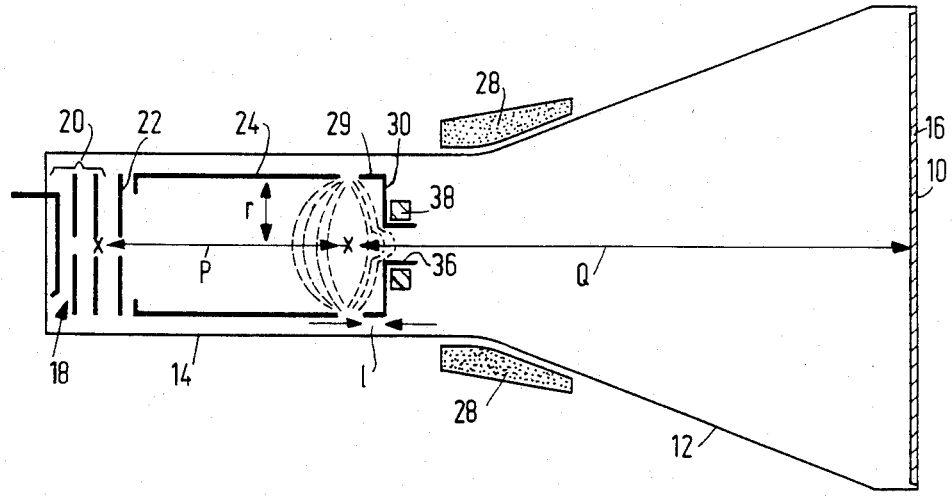
FIG. 2 is a diagrammatic longitudinal sectional view through a cathode ray tube made in accordance with the present invention.

The cathode ray tube made in accordance with the present invention enables the values of $V_f$ to be at an acceptable value while allowing the diameter of the cylindrical electrode 24 to be as large as possible. Referring to FIG. 2, the open-ended cylindrical accelerating electrode 26 of FIG. 1 is replaced by a short cylindrical electrode 29 which at its screen end is closed by a diaphragm 30 having an aperture of suitable shape, for example circular, elliptical, rectilinear, such as square and rectangular, or polygonal. The length, 1, of the cylindrical electrode 29 is less than the radius, r, of the cylindrical focusing electrode 24. The size of the aperture is such that its area is less than half the cross sectional area of the electrode 24. In the case of diaphragm 30 having a circular aperture, a typical aperture diameter is 4 mm for a value of D=18 mm. In operation the diaphragm is held at the screen voltage, for example 30 kV.

If the values of P and Q remain unchanged from those in FIG. 1, then the simple substitution of the diaphragm 30 in place of the cylinder 26, although providing a more acceptable adaption electrically of the triode part 20 to the main lens, does introduce a spherical aberration quality-degrading influence from 3.61 in FIG. 1 to 4.23 in FIG. 2, that is an increase in spot size by 17%. This quality degrading influence can be reduced so that an acceptable value is achieved by reducing the lens-to-screen distance, Q. This reduction in the lens-to-screen distance is allowable because the lens field extends a short distance in the direction of the screen. Also the object-to-lens distance can be increased by keeping the tube length (object-to-screen distance) the same. These two changes effectively compensate for the deterioration in quality value due to the introduction of the diaphragm 30. By way of example in FIG. 2, Q is 145 mm, P is 65 mm and $V_f$ is 7,2 kV. The spherical aberration quality factor has a value of 3.85 so that taking FIG. 1 as a reference the spot size has increased by only 7% which is within acceptable limits, especially for a projection television tube.

FIG. 2 illutrates a neck getter 38 mounted in the proximity of the diaphragm 30. In order to prevent gettering material, particularly barium, from being deposited in the lens electrtodes, a cyindrical collar 36 (or "chimney") is provided on the screen side of the diaphragm 30.

Figure 3:
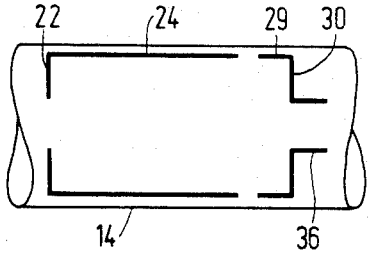
FIGS. 3 and 4 are sketches showing variations of the structure of the bipotential lens electrodes.

As $V_f$(=7.2 kV) is generally of the same order as the voltage on the prefocusing electrode 22 then they can be connected together internally of the envelope thereby saving an external connection. More conventionally, as shown in FIG. 3, the prefocusing lens can be integrated with the cylindrical focusing lens electrode 24.

Figure 4:
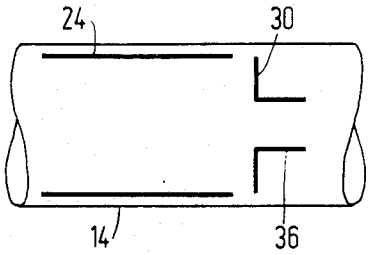

At the limit of the difference between the length 1 of the cylindrical portion 29 and the radius r of the cylindrical electrode 24, namely when $1=0$, then the focusing lens comprises the cylindrical electrode 24 and the diaphragm 30, as shown in FIG. 4.

Figure 5:
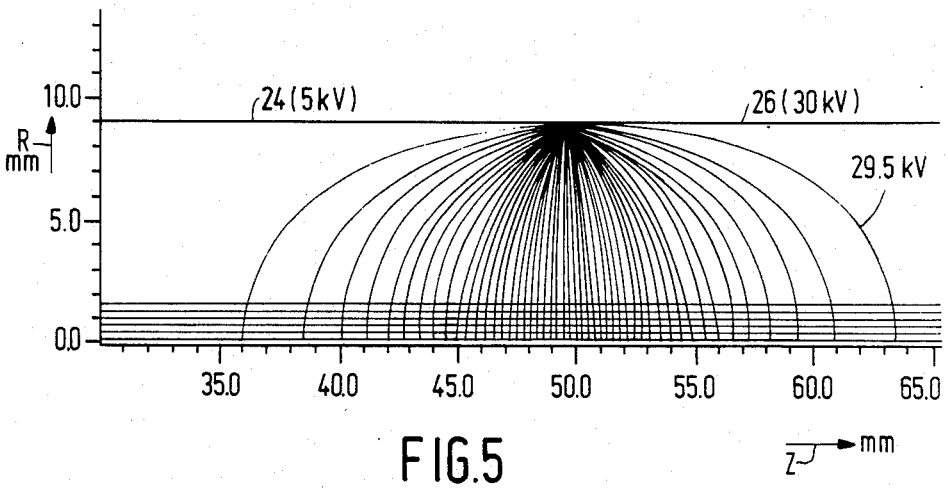
FIG.5 PRIOR ART
FIG. 5 and 6 are computer plots of the bipotential lenses shown in FIGS. 1 and 4, respectively, the ordinate representing the radial distance R in millimeters and the abscissa the distance in millimetres along the Z-axis.
Figure 6:
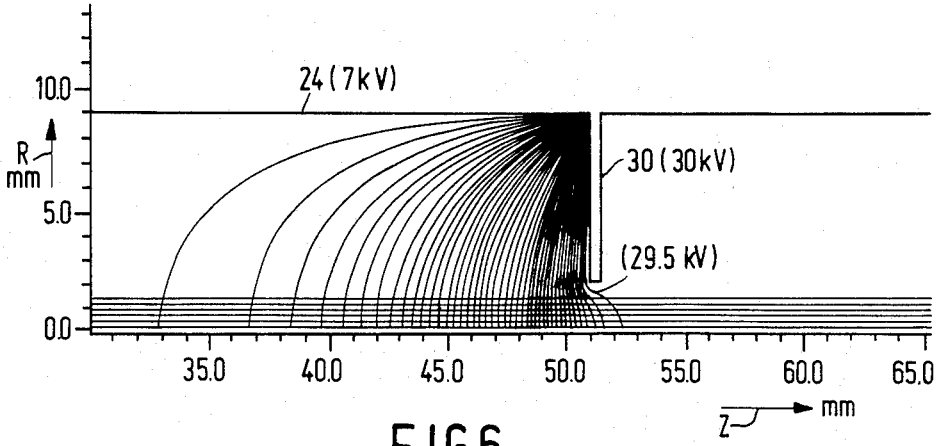

FIG. 5 and 6 are computer plots of the focusing electron lenses formed by the axially separated cylinders 24, 26 of FIG. 1 and by the cylinder 24 and the diaphgram 30 of FIG. 4, respectively. As is customary with such plots only the lens field on one side of the Z-axis has been shown, the lens field on the other side of the Z-axis being assumed to be the same. Comparing FIGS. 5 and 6 it will be noted in FIG. 6 there are very few equipotentials on the screen side of the diaphragm 30. Taking the 29.5 kV equi-potential lines as an example, in FIG. 5 this line extends approximately 11 mm further towards the screen than in FIG. 6. This allows the lens at FIG. 6 to be positioned 11 mm closer to the screen than that of FIG. 5, keeping the amount of overlap between the lens field and the deflection field the same.

What is claimed is:

1. A cathode ray tube including an envelope containing a luminescent screen and an electron gun for producing and focusing an electron beam directed at said screen along a longitudinal axis of the envelope, said electron gun including:

a. a triode portion for producing the electron beam and focusing said electron beam at an object point; and b. first and second adjacent bipotential focusing lens electrodes for producing therebetween a lens for focusing the electron beam onto the screen;

said first electrode being disposed between the triode portion and the screen and comprising a cylindrical electrode having a radius at an end thereof adjacent the second electrode which is maximized within the confines of the envelope and having a predetermined axial length;

said second electrode being disposed between the first electrode and the screen, having a predetermined axial length, and comprising a diaphragm extending transversely of the axis and including an aperture for passing the electron beam, said aperture having a cross-sectional area which is smaller than one-half of said first electrode's cross-sectional area;

said predetermined axial lengths being dimensioned to optimize the quality C of the lens in accordance with the formula:

$$C^{\frac{1}{2}} = K \cdot \frac{Q}{P^{\frac{1}{2}} D^{\frac{1}{2}}}$$

where K is approximately equal to 1.5, Q is the lens-to-screen distance, P is the lens-to-object-point distance, and D is the lens diameter.

2. A cathode ray tube as in claim 1 where the axial length of the second electrode is substantially equal to zero.

3. A cathode ray tube as in claim 1 or 2 where the aperture of the diaphragm is circular.

4. A cathode ray tube as in claim 1 or 2 where the aperture of the diaphragm is rectilinear.

5. A cathode ray tube as in claim 1 or 2 where the aperture of the diaphragm is elliptical.

6. A cathode ray tube as in claim 1 or 2 where the aperture of the diaphragm is polygonal.

7. A cathode ray tube as in claim 1 or 2 including prefocusing electrode means disposed between the triode portion and the first electrode, said prefocusing electrode means being electrically connected to said first electrode.

8. A cathode ray tube as in claim 1 or 2 including a prefocusing electrode at and integrally formed with an end of the first cathode at which the electron beam is received from the triode portion.

9. A cathode ray tube as in claim 1 or 2 including a collar surrounding the aperture of the diaphragm and extending toward the screen.

10. A cathode ray tube as in claim 1 or 2 where said tube is a projection tube.

* * * * *